US007810555B2

(12) United States Patent
Shampine et al.

(10) Patent No.: US 7,810,555 B2
(45) Date of Patent: Oct. 12, 2010

(54) INJECTOR APPARATUS AND METHOD OF USE

(75) Inventors: Rod W. Shampine, Houston, TX (US); Lawrence J Leising, Missouri City, TX (US); Yarom Polsky, Albuquerque, NM (US); Hubertus V. Thomeer, Houston, TX (US); Sarmad Adnan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 218 days.

(21) Appl. No.: 11/673,823

(22) Filed: Feb. 12, 2007

(65) Prior Publication Data

US 2007/0175642 A1 Aug. 2, 2007

Related U.S. Application Data

(63) Continuation-in-part of application No. 11/014,598, filed on Dec. 16, 2004, now Pat. No. 7,281,588.

(51) Int. Cl.
*E21B 19/22* (2006.01)
*E21B 19/08* (2006.01)

(52) U.S. Cl. ..... 166/77.2; 166/77.1; 166/77.53; 226/182

(58) Field of Classification Search ..... 166/382, 166/384, 77.2, 77.1, 77.53, 88.2, 379; 226/176, 226/181, 182
See application file for complete search history.

(56) References Cited

U.S. PATENT DOCUMENTS

| | | | | |
|---|---|---|---|---|
| 1,586,923 | A | 6/1926 | Townsend | |
| 3,215,203 | A | 11/1965 | Sizer | |
| 4,154,310 | A | 5/1979 | Konstantinovsky | |
| 5,992,516 | A * | 11/1999 | Palynchuk et al. | 166/77.2 |
| 6,264,128 | B1 | 7/2001 | Shampine | |
| 6,273,188 | B1 | 8/2001 | McCafferty | |
| 6,527,055 | B1 * | 3/2003 | Gipson | 166/379 |
| 7,032,690 | B2 * | 4/2006 | Ramey et al. | 175/57 |
| 2001/0040031 | A1 | 11/2001 | Shaaban | |
| 2004/0020639 | A1 | 2/2004 | Saheta | |
| 2005/0039926 | A1 * | 2/2005 | Mackay et al. | 166/384 |

FOREIGN PATENT DOCUMENTS

| | | |
|---|---|---|
| EP | 0395167 | 4/1995 |
| EP | 0486324 | 3/1996 |
| GB | 1265338 | 9/1969 |

* cited by examiner

*Primary Examiner*—Daniel P Stephenson
*Assistant Examiner*—Brad Harcourt
(74) *Attorney, Agent, or Firm*—Michael Dae; David Cate; Robin Nava

(57) ABSTRACT

The invention generally relates to an apparatus and/or a method for moving an round flexible member into and out of a well bore, and particularly, to an injector with two or more gripping members which bind the outer surface of the round flexible member; two or more actuators which cause the gripping members to bind or release the round flexible member; and at least one reciprocator for translating a gripping member to move the round flexible member, or for repositioning the gripping member. A method of translating a round flexible member is also provided which includes the steps of binding the outer surface of a round flexible member with at least one gripping members by engagement with an actuator, and translating a gripping member by reciprocator to move the round flexible member.

27 Claims, 7 Drawing Sheets

INJECTOR APPARATUS AND METHOD OF USE

CROSS-REFERENCE TO RELATED APPLICATION

This application claims priority to and is a Continuation in Part of U.S. patent application Ser. No. 11/014,598, filed on Dec. 16, 2004, now U.S. Pat. No. 7,281,588 which is incorporated herein by reference.

FIELD OF THE INVENTION

The present invention relates generally to a method and apparatus for moving round flexible members into and out of a well bore, and more particularly to an injector and methods of use thereof.

BACKGROUND

In the oil and gas industries it is commonplace for coiled tubing to be used for well drilling or other well bore operations, such as deploying reeled completions equipment, logging high angled boreholes, positioning tools, instruments, motors and the like, and/or deploying treatment fluids.

Coiled tubing is formed as a continuous string of pipe and therefore in many applications it is easier and faster to deploy into a well than conventional pipe, particularly in horizontal or multi-lateral wells. Most coiled tubing strings installed into well bores are composed of a steel material, which is injected into the well with a hydraulically activated injector head that has two opposed rolling surface areas that effectively push the tubing into the well from above the well head, using friction to ensure control and movement of the tubing into the well bore and thereby exerting compressive forces on the tubing. The coiled tubing is typically small in diameter, usually a tubing having an outside diameter of about 1.5 cm to 9 cm, and sufficiently flexible to be coiled onto a drum to form the tube reel. Coiled tubing is thus relatively easy to store and transport, and may be provided in long sections (typically 6,500 meters) such that the tubing may be deployed relatively quickly.

Typically, the coiled tubing is shipped, stored, and used on the same coiled tubing reel. Coiled tubing reels are deployed from trucks or trailers for land-based wells and from ships or platforms for offshore wells. When spooling or unspooling coiled tubing from a reel, the tubing is subjected to bending forces that can cause tubing fatigue. This fatigue is a major factor in determining the useful life of a coiled tubing work string. Coiled tubing reels typically rely on hydraulic power to operate the reel drive, brake, and spooling guide systems. Most coiled tubing reels can be powered in "in-hole" [i.e. running-in-hole (RIH)] and in "out-hole" [i.e. pulling-out-of-hole (POOH)] directions.]

The reel drive and its associated motor provide the reel back-tension, that is the tension in the coiled tubing between the reel and the injector that is used to spool and unspool the tubing from the reel, prevent tubing sagging between the reel and the injector while running coiled tubing into or out of the wellbore, and keep the wraps of tubing secure on the reel. When coiled tubing is moving out of the well, the reel exerts a force as the tubing is bent and then secured onto the reel. This force imparts both elastic and plastic deformation energy into the tubing as it is bent. Conversely, as the tubing is moved into the well, the elastic energy along with the energy imparted to keep the tubing wraps tightly secured to the reel must be dissipated. This energy is normally dissipated as heat in the hydraulic system, or may be dissipated in a separate braking system.

Conventional coiled tubing operation equipment typically includes coiled tubing spooled on a reel to be dispensed onto and off of the reel during an operation; an injector to run coiled tubing into and out of a well; a gooseneck affixed to the injector to guide the coiled tubing between the injector and the reel; a control cab with the necessary controls and gauges; and a power source. Additional or auxiliary equipment also may be included. Coiled tubing equipment, such as that described in U.S. Pat. No. 6,273,188 (McCafferty et al.), which incorporated herein by reference, is widely known in the industry.

In a typical coiled tubing configuration, the power source comprises a diesel motor that is used to operate one or more hydraulic pumps. The motor, pump(s) and other functions of the unit are controlled from the control cab. Between the injector head and the reel resides the tubing guide or gooseneck. The tubing extends from the reel to an injector. The injector moves the tubing into and out of the wellbore. Between the injector and the reel is a tubing guide or gooseneck. The gooseneck is typically attached or affixed to the injector and guides and supports the coiled tubing from the reel into the injector. Typically, the tubing guide is attached to the injector at the point where the tubing enters the injector, and serves to control the entry of the tubing into the injector.

As the tubing wraps and unwraps on the reel, the point of contact with the stored tubing moves from one side of the reel to the other (side to side) and the gooseneck controls the bending radius of the tubing as it changes direction. The gooseneck typically has a flared end that accommodates this side to side movement. Goosenecks are widely known in the field, including those disclosed in U.S. Pat. Application 2004/0020639 (Saheta, et al.), which is incorporated herein by reference.

Conventional injector heads include a chain drive arrangement which acts as a coiled tubing conveyor. Two loops of chain are provided, typically carrying blocks which grip the tube walls. The chains are mounted on sprockets driven by hydraulic motor(s), using fluid supplied from the power pack. Such coiled tubing units have been in use for many years.

However, the Applicant has identified a number of problems associated with the existing apparatus. For example, the force which must be applied to the tubing by the injector head is usually considerable, and requires that the tubing is clamped tightly between the blocks carried by the driven chains. These large forces may also result in permanent radial deformation of the tubing, a phenomenon known in the industry as "slip crushing." When slip crushing occurs in the injector, that section of tubing may shrink until it stops transferring axial load to the injector, which in turn may increase the tubing stresses in other parts of the gripping area, potentially leading to complete loss of gripping. Slip crushing also renders the tubing unsafe for use and must therefore be replaced at great expense.

Further, the apparatus often operates in difficult conditions, and the injector head is continually exposed to a variety of fluids carrying various particulates that can wear down parts of the apparatus, such that frequent maintenance is required. Also, a fundamental problem with conventional injectors is that many of the modes of injector failure cause the tubing to fall freely into the well, or conversely, be ejected by pressure forces from the well. Such modes of failure include motor failure, brake failure, chain failure, cavitation, loss of hydraulic oil, shaft breakage, gripper loss, etc. Finally, the processes and apparatus are very expensive and unreliable because of the use of elaborate equipment and apparatus means.

As such, a need exists for a method and/or a device for moving, or injecting, coiled tubing into and out of a well bore using simple devices which better maintain tubing integrity, minimize loss of coiled tube control, and/or require less maintenance.

SUMMARY

The invention generally relates to an apparatus and method for moving round flexible members into and out of a well bore, and particularly, to an injector and methods of use thereof. The injector generally includes two or more gripping members which bind the outer surface, or circumference, of a round flexible member; two or more actuators which cause the gripping members to bind or release the round flexible member; and at least one reciprocator for translating a gripping member to move the round flexible member, or for repositioning the gripping member.

In one embodiment of the invention, an injector includes three gripping members, each binding the outer surface of round flexible member; actuators for enabling or disabling each gripping member; and a reciprocator for translating a gripping member to move the round flexible member or repositioning the gripping member. The gripping members are slip type members with grooves to enhance gripping, and the actuators engage and force the gripping members to bind with the outer circumference of the round flexible member. The reciprocator is hydraulically driven.

In another embodiment of the invention, an injector is provided which includes at least one reciprocator for translating a gripping member to move a round flexible member or repositioning the gripping member, wherein the reciprocator includes a housing, a hydraulic piston, a hydraulic cylinder encasing the hydraulic piston, and a chamber and conduit to deliver hydraulic pressure to the hydraulic cylinder connected to the hydraulic motor. The injector also includes slip type gripping members, wherein each member binds the outer surface of the round flexible member, and bowl shaped actuators for enabling or disabling the gripping members which are in contact with and driven by the hydraulic piston.

A method of translating a round flexible member is also provided which includes the steps of binding the outer surface of the round flexible member with at least one gripping member by engagement with an actuator, and translating a gripping member by a reciprocator to move the round flexible member.

DETAILED DESCRIPTION OF EMBODIMENTS OF THE INVENTION

Figure 1:
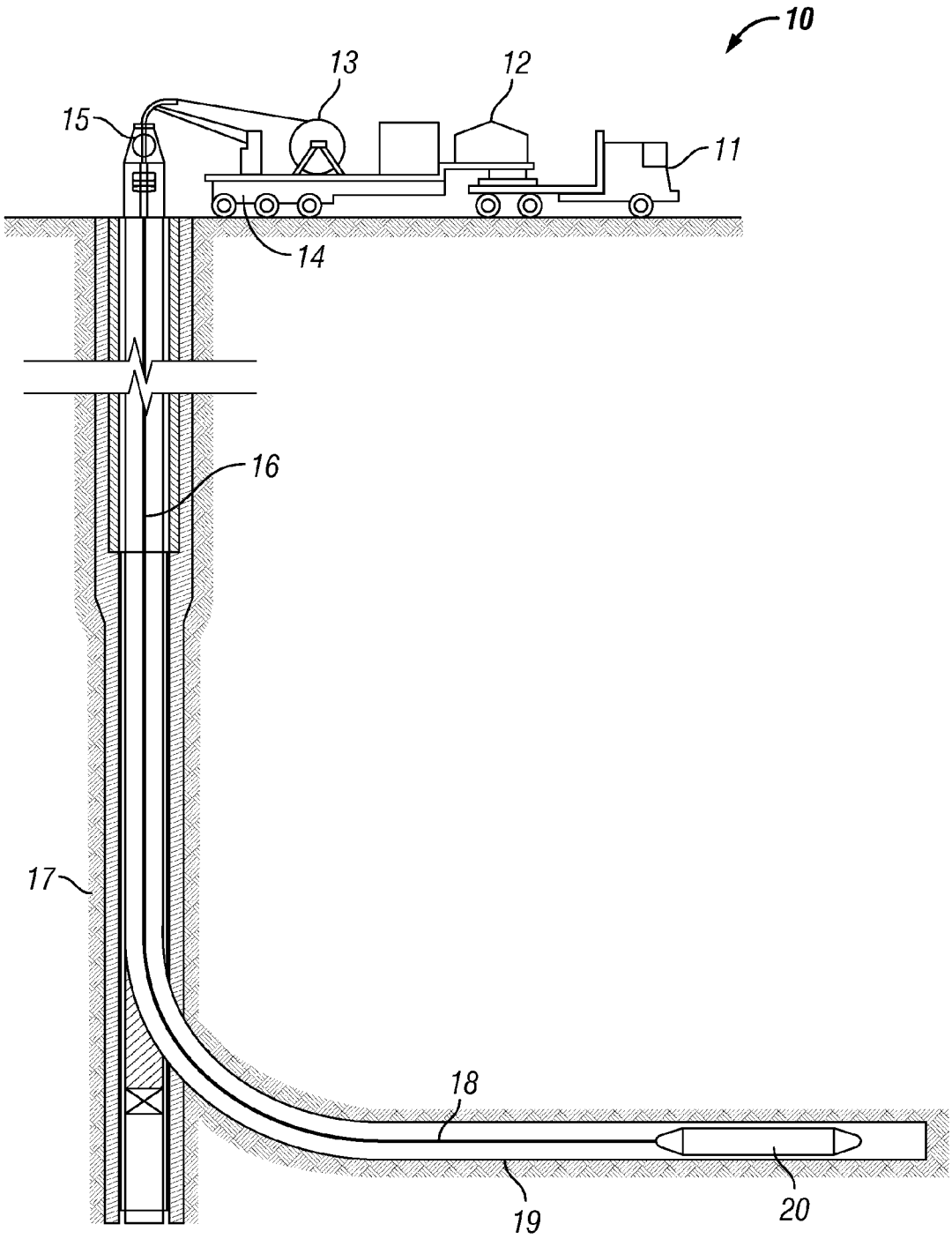
FIG. 1 shows a coiled tubing assembly according to one embodiment of the present invention.

The description and drawings are presented solely for the purpose of illustrating the embodiments of the invention and should not be construed as a limitation to the scope and applicability of the invention. While the embodiments of the present invention are described herein as comprising certain features and/or elements, it should be understood that embodiments could optionally comprise further features and/or elements. In addition, the embodiments may also comprise features and/or elements other than the ones cited.

Embodiments according to the invention generally relate to a method and/or an apparatus for moving an elongated round flexible member into and out of a well bore, and particularly, to an injector and methods of use thereof. According to the invention, there is provided an apparatus for conveying an elongated round flexible member. In one embodiment, the apparatus comprises two or more gripping members, wherein each member binds the outer surface of the elongated round flexible member; two or more actuators which cause the gripping members to bind or release the round flexible member; and at least one reciprocator for translating a gripping member to move the round flexible member, or for repositioning the gripping member. By "circumferentially binding" or "binding" the outer surface of the round flexible member it is generally meant that one or more gripping members surround the round flexible member and bind it by making significant, substantial, or even contiguous contact with an outer circumference of the round flexible member.

The elongated round flexible member may be a string of coiled tubing, or another relatively thin walled tube useful in the oil and gas industries, such as jointed tubulars or drill pipe, and the like. Alternatively, the elongated round flexible member may be a cable, such as a wireline cable, a slickline cable, or an umbilical, each of which is typically used for conveying tools into and out of a well. In addition, the elongated round flexible member may be any elongated round flexible device which is desired to be conveyed into and/or out of a well. As such, although a majority of the description below and illustrated depictions focus on the elongated round flexible member as being coiled tubing, it is to be understood that the elongated round flexible member may be any of the device listed above.

The use of gripping members that bind, or circumferentially bind, the outer surface, or circumference, of the elongated round flexible member (such as a coiled tubing string) helps minimize the plastic deformation of the round flexible member when bound by the gripping members, which often occurs in conventional tubular injectors having opposing pairs of clamping blocks. Further, using gripping members that bind the round flexible member may provide a tighter grip force. The ability to bind the round flexible member with a greater force helps overcome the low friction conditions typically encountered when using round flexible member in well bores. Also, using the gripping members according to the invention minimizes loss of control of the round flexible member.

Coiled tubing is commonly used for well drilling or well bore operations, such as drilling wells, deploying reeled completions, logging high angled boreholes, positioning tools, instruments, motors and the like, and deploying treatment fluids. Coiled tubing is typically composed of a steel material formed as a tube. However, in embodiments of the invention, the coiled tubing may be composed of any useful material, such as aluminum, copper, plastic, rubber, and the like.

FIG. 1 shows a typical coiled tubing operating environment according to one embodiment of the invention. In FIG. 1, a coiled tubing operation 10 comprises of a truck 11 and/or trailer 14 that supports a power supply 12 and a tubing reel 13. While an on-land operation is shown, the method or device according to the present invention is equally well suited for use in drilling for oil and gas as well and other coiled tubing operations both on land and offshore. Such trucks or trailers for coiled tubing operations are known. One such trailer is described in U.S. Pat. No. 6,237,188 (McCaferty et al.), which is incorporated herein in its entirety by reference.

An injector head unit 15 feeds and directs an elongated round flexible member, such as a coiled tubing string 16, from the tubing reel 13 into the subterranean formation 17. The configuration of FIG. 1 shows a horizontal wellbore configuration which supports a coiled tubing trajectory 18 into a horizontal wellbore 19. However, this invention is not limited to a horizontal wellbore configuration. A downhole tool 20 is connected to the coiled tubing 16, as for example, to conduct flow or measurements, or perhaps to provide diverting fluids.

Figure 2:
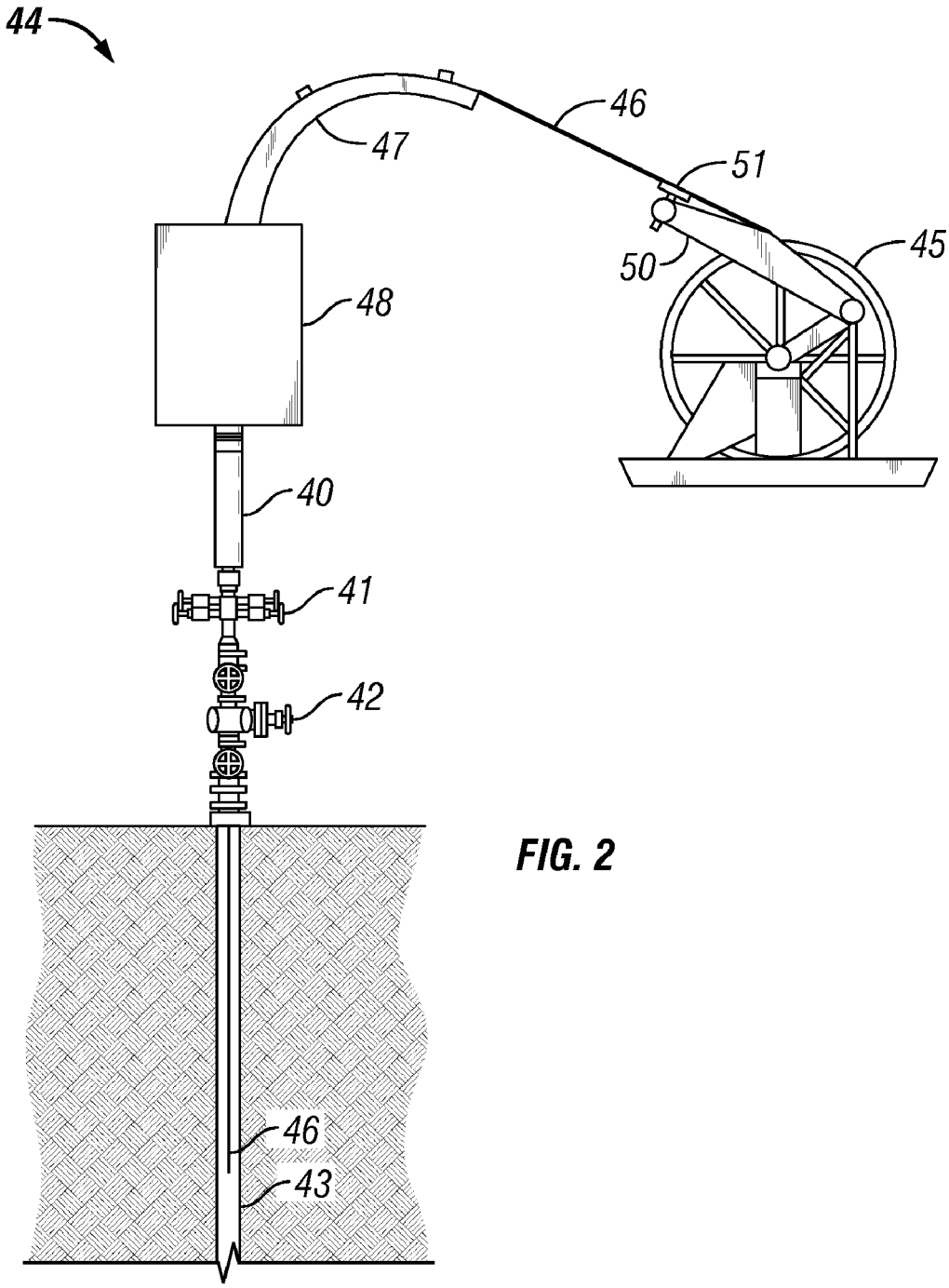
FIG. 2 represents a coiled tubing unit having a hydraulically operated tubing reel, gooseneck, and injector.

FIG. 2 represents a coiled tubing unit 44 having a reel 45 for storing a string of coiled tubing 46; a gooseneck 47 for guiding the coiled tubing 46 from the reel 45 to an injector 48; and the injector 48 for forcing the coiled tubing 46 into or out of the well 43. The coiled tubing 46 is guided from the reel 45 by way of levelwind assembly 50. Levelwind assemblies are known by those skilled in the art. One such levelwind assembly 50 is described in U.S. Pat. No. 6,264,128 (Shampine, et al.), which is incorporated herein in its entirety by reference. A coiled tubing brake 51 on the levelwind assembly 50 is shown. As shown, the coiled tubing 46 is bent as it passes over the gooseneck 47, and is straightened as it goes into the injector head 48 for entry into the well 43. Of course, each bending event is repeated in reverse when the coiled tubing 46 is later extracted from the well 43. For sealing off pressure from the well 43, a stripper 40 and a blow out preventer 41 are disposed above the wellhead 42.

According to the invention, any gripping member design may be used which is effective to bind the outer surface of the elongated round flexible member, such as a string of coiled tubing. Examples of suitable designs include, but are not necessarily limited to, annular bag or metallic diaphragms, rubber elements compressed axially or radially using mechanical or hydraulic power, slip type grippers moving radially or on spiral paths, collet type grippers, and the like. Other examples of suitable designs which operate on the principle that load increases grip include, but are not necessarily limited to, wrapping springs or straps, basket weave grip (axial pull tightens grip), magnetostrictive, piezoelectric, shape memory alloy, and the like.

Figure 3:
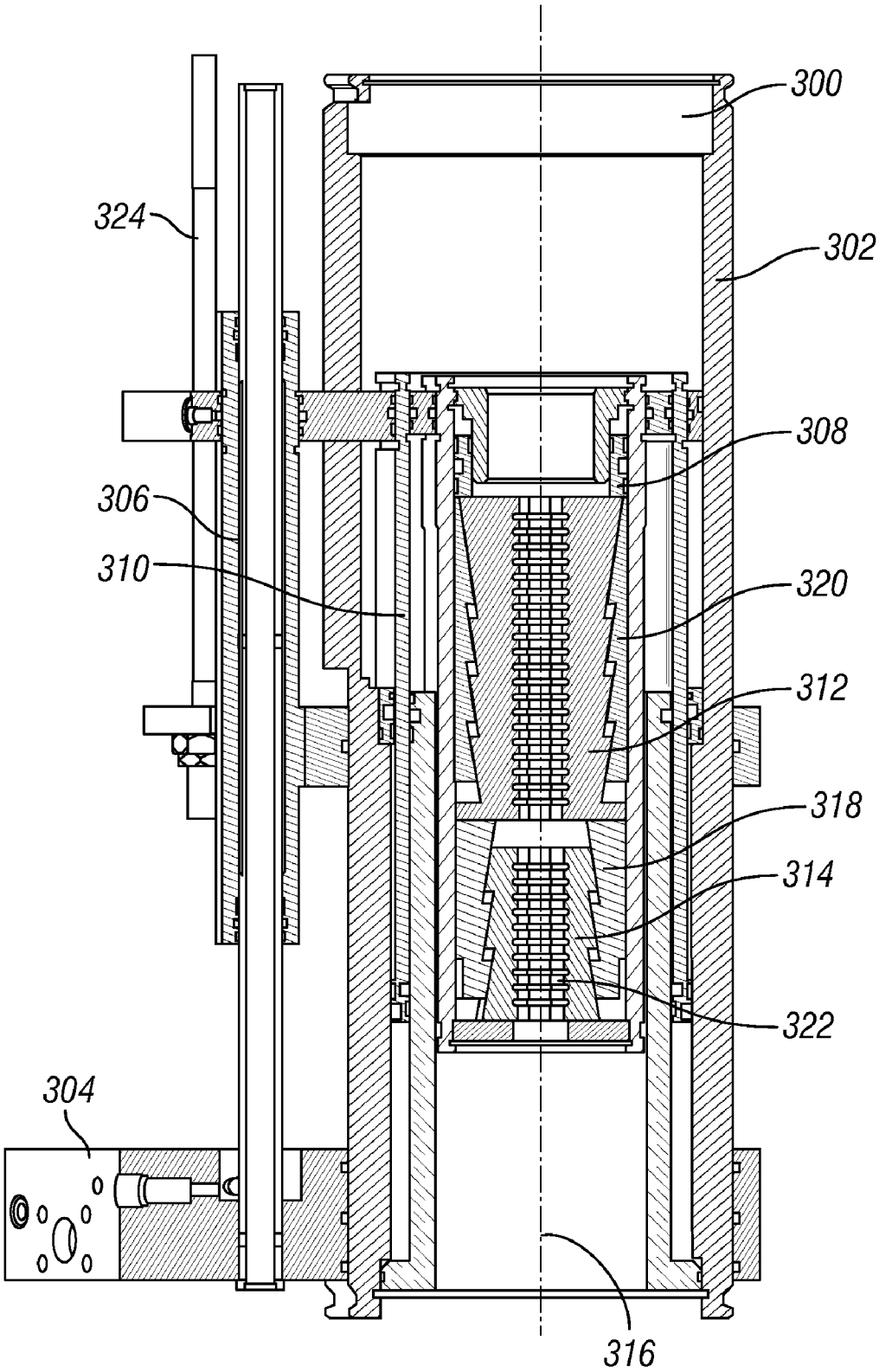
FIG. 3 illustrates in cross-section, an injector according to one embodiment of the invention.

FIG. 3 illustrates in cross-section, a first embodiment of an injector 300 according to one embodiment of the invention. This injector 300 may be used in the overall coiled tubing assembly 44 of FIG. 2. As shown, the injector 300 comprises a reciprocator, which in turn, comprises a housing 302 which is connected with a hydraulic manifold 304, and a chamber 306 to deliver hydraulic pressure to a hydraulic cylinder 308. Hydraulic pressure drives a hydraulic piston 310 which serves to translate an elongated round flexible member (not shown), as described below. Note that the elongated round flexible member is omitted from FIG. 3 for clarity but if it were shown it would be disposed along the centerline 316.

In the depicted embodiment, the injector 300 comprises slip type gripping members 312 and 314 for binding the outer surface of the round flexible member placed along centerline 316, and bowl shaped actuators 318 and 320 to enable the gripping members 312 and 314 to bind or release the round flexible member. In one embodiment, the gripping member 312 and the actuator 318 are connected to each other and to the piston 310, such that when the piston 310 moves downwardly in the depiction of on FIG. 3, the gripping members 312 and 314 move both downwardly and radially inwardly due to the angled contact surfaces of the gripping members 312 and 314 that are in contact with corresponding angled contact surfaces on the actuators 318 and 320. The radial inward movement of the gripping members 312 and 314 causes the gripping members 312 and 314 to contact and bind the outer surface of the elongated round flexible member. Once the gripping members 312 and 314 are in contact with the elongated round flexible member, continued downward movement by the piston 310 causes both the gripping members 312 and 314 and the elongated round flexible member to move downwardly.

By contrast, a movement of the piston 310 in the upward direction causes the gripping members 312 and 314 to release the elongated round flexible member and reset to a starting position, wherein the gripping members 312 and 314 are ready to re-grip the elongated round flexible member. The depiction of FIG. 3 may be referred to as a stroke unit. Note that by positioning multiple stroke units in series (i.e. one on top of the other along centerline 316) the gripping members of one stroke unit may be gripping and translating the elongated round flexible member while the gripping members of another stroke unit are resetting.

As shown in FIG. 3, the gripping members 312 and 314 may include have grooves 322 disposed about their gripping surfaces to enhance a circumferential binding of the gripping surfaces with the round flexible member, which is particularly useful when the round flexible member has a coating of a foreign material, such as oil, grease, grit, and the like. A position transducer 324 may be further used to indicate the position of the piston 310.

Figure 4:
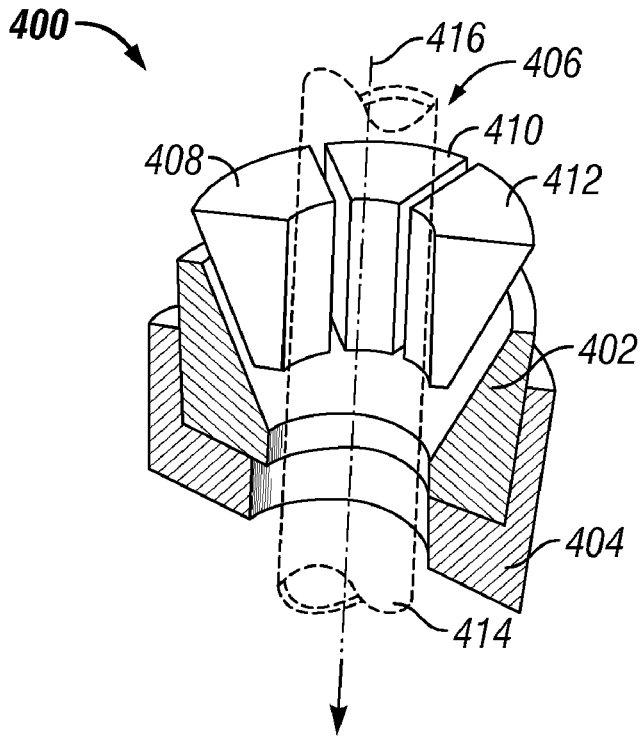
FIG. 4 is a three dimensional cross-section illustration of slip type gripping members for use in an injector according to one embodiment of the invention.

When slip type gripping assemblies are used in injectors according to the invention, they are effective for reducing the slip-crushing load from that of a simple slip. Slip type assemblies preferably include a bowl and a movable gripping members, however either component may be fixed or movable. Referring now to FIG. 4, a three dimensional cross-sectional illustration of one embodiment of a slip type grip assembly 400 according to the invention is shown. As shown, the slip type grip assembly 400 comprises a fixed bowl 402 secured with the injector housing 404 and a moving gripping member 406 comprising a plurality of slip sections, as illustrated by sections 408, 410, and 412. The moving gripping member 406 is orientated in such way that moving an elongated round flexible member 414 in a downhole direction, axially along centerline 416 increases the gripping force of the grip assembly 400 on the elongated round flexible member 414.

Downward axial forces act upon slip sections 408, 410, and 412, sliding the moving gripping member 406 into the bowl 402, producing a large radial force, which is dependent upon the angle of the bowl 402. Once the bowl 402 and the moving gripping member 406 are engaged, the downward axial force on the round flexible member 414 is translated into gripping force in direct proportion. For any elongated round flexible member surface coefficient of friction, an appropriate bowl angle may be selected which optimally secures the round flexible member 414.

Figure 5:
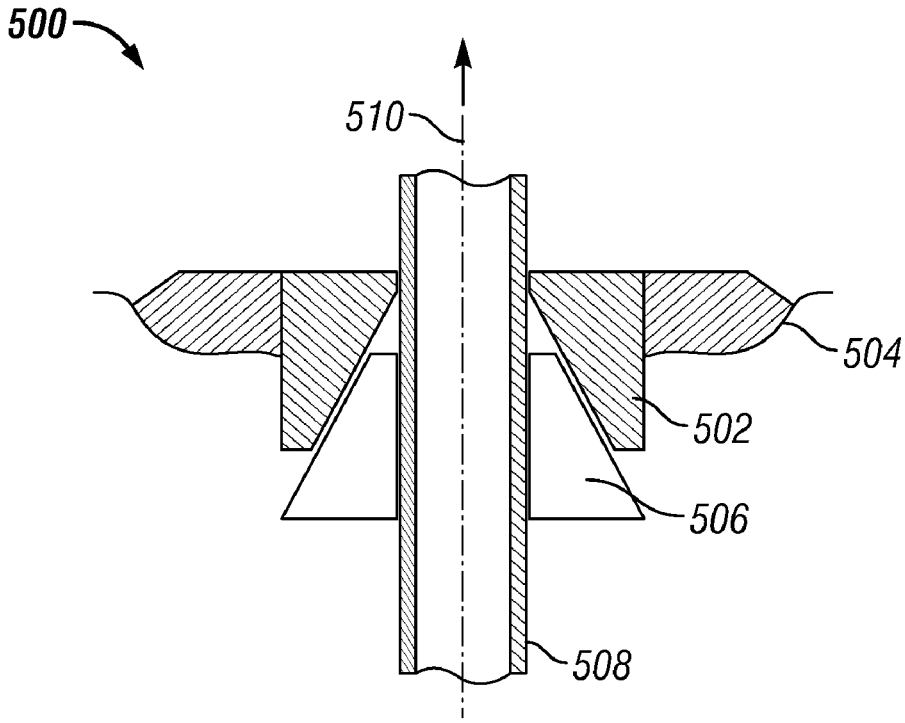
FIG. 5 is a cross-sectional illustration of slip type gripping members for use in an injector according to another embodiment of the invention.

Referring to FIG. 5, a cross-sectional illustration of a slip type grip assembly 500 according to the invention is shown. In this embodiment, the slip type grip assembly 500 comprises a fixed bowl 502 secured with the injector housing 504 and a moving gripping member 506. The fixed bowl 502 and a moving gripping member 506 are oriented so that moving an elongated round flexible member 508 in an upward direction from the well bore axial to centerline 510 (snubbing the round flexible member) increases the gripping force on the round flexible member 508.

Figure 6:
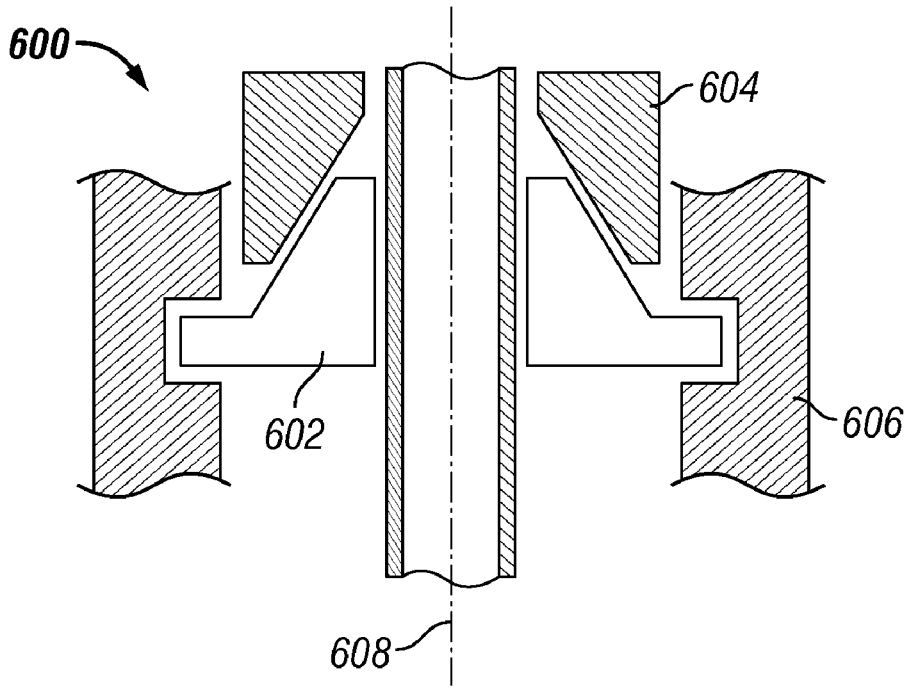
FIG. 6 is a cross-sectional illustration of slip type gripping members for use in an injector according to another embodiment of the invention.

FIG. 6 illustrates a cross-sectional illustration of another slip type grip assembly 600. As shown, the grip assembly 600 includes a fixed gripping member 602 and a moving bowl 604 orientated so that the elongated round flexible member load force does not affect the gripping force. According to FIG. 6, in the grip assembly 600, the fixed gripping member 602 may be secured to the injector housing 606 in such way that the fixed gripping member 602 is fixed from moving in any axial direction parallel to centerline 608, but may move in a radial direction in a plane perpendicular to centerline 608.

Figure 7:
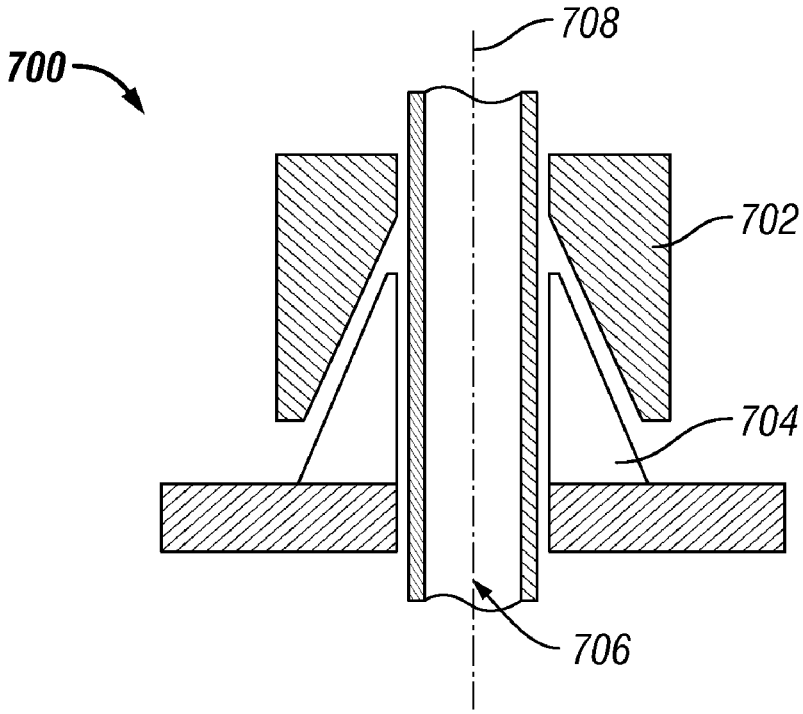
FIG. 7 is a cross-sectional illustration of slip type gripping members for use in an injector according to another embodiment of the invention.

Further, FIG. 7 illustrates yet another slip type grip assembly 700. As shown, the grip assembly 700 includes having a moving bowl 702 and a fixed gripping member 704 orientated in such way that moving a round flexible member 706 in a downhole direction axial to centerline 708 does not affect the grip assembly 700 gripping force, but snubbing tightens the grip as the round flexible member 706 is moved upward. Furthermore, the bowl 702 and gripping member 704 may be orientated such that snubbing the round flexible member 706 does not affect the gripping force but pulling tightens the grip.

Slip type grip assemblies used in injectors according to the invention may be combined in serial or parallel fashion. The gripping members may also be combined in such serial or parallel fashion where there are one or more devices applying gripping force and/or axial force. Also forces may be transferred through different gripping members to control how forces are distributed between a plurality of gripping members.

Hydraulically set and spring released or spring set and hydraulically released actuators are effective for enabling or disabling the gripping members to bind or release the elongated round flexible member. Slip type grip assemblies may be designed so that the grip cannot be released while carrying a round flexible member load. Also, as a safety measure, a slip gripping member may be designed, by adjusting the taper angle, such that it will slip-crush the round flexible member rather than release, and while any suitable angle may be used in this case, about a ten degree taper angle is preferred.

In one embodiment, the injector uses two gripping members, both of which can accommodate ±2 mm diameter variation in the round flexible member. The gripping members bind the round flexible member by enablement with an actuator, such as a slip bowl, and an annular piston capable of applying up to 17,700 kilograms of force. An upper gripping member is designed so that the pull on the elongated round flexible member tightens its grip and the taper angle is such that it cannot slip on oily elongated round flexible members. The additional gripping force provided by hydraulics allow it to handle paraffin coated round flexible members. A bottom gripping member is designed so that its gripping force does not change with the pull of the round flexible member, but the gripping force includes both the hydraulic force and the axial pull force carried by the upper gripping member. This combination reduces slip-crushing stress in the round flexible member and allows the round flexible member to be pulled harder at a given coefficient of friction.

Embodiments of injectors according to the present invention may also use gripping members comprising a plurality of sections which may be arranged to carry similar loads yet accommodate varying round flexible member shapes or contact positions. This may be accomplished using tilting or hydrostatic mechanisms, including liquid and solid hydrostatic media such as rubber, polymers, and the like.

Figure 8:
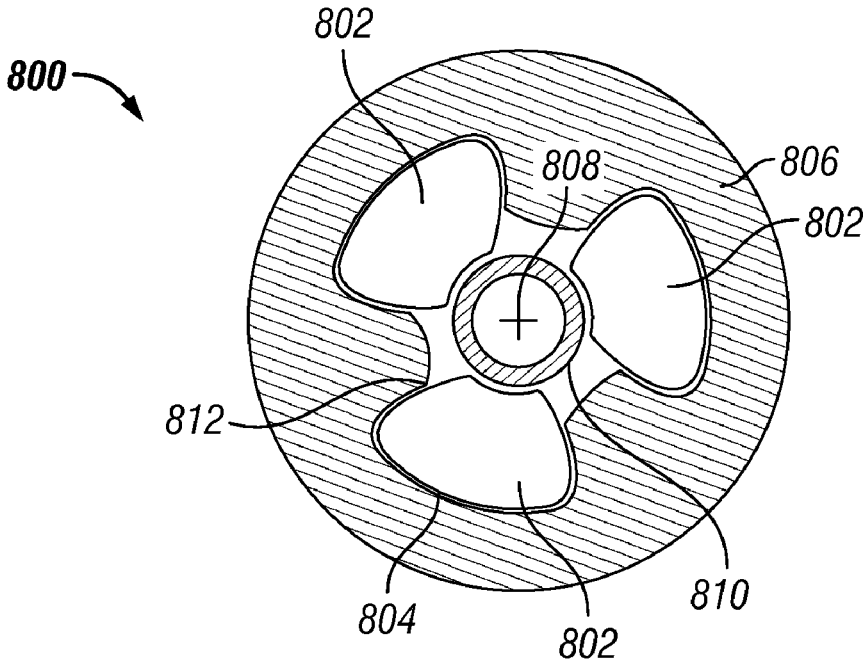
FIG. 8 is a cross-sectional top view showing tiltable gripping members having multiple sections of slip type gripping members for use in an injector according to another embodiment of the invention.

Referring to FIG. 8, a cross-sectional top view a grip assembly 800 having multiple tilting sections is shown. As shown, the grip assembly 800 comprises gripping members 802 which have round outer surfaces 804 seated in a cylindrical groove of a body 806. The grooves are formed angularly with the center axis 808 upon which a round flexible member 810 is placed. A gripping force is placed upon or released from the round flexible member 810 as it is moved along axis 808 causing the gripping members 802 to move both along axis 808 and in a plane perpendicular thereto. The gripping members 802 may also be free to pivot with the groove to equalize contact forces placed upon the contact surfaces 812.

Figure 9:
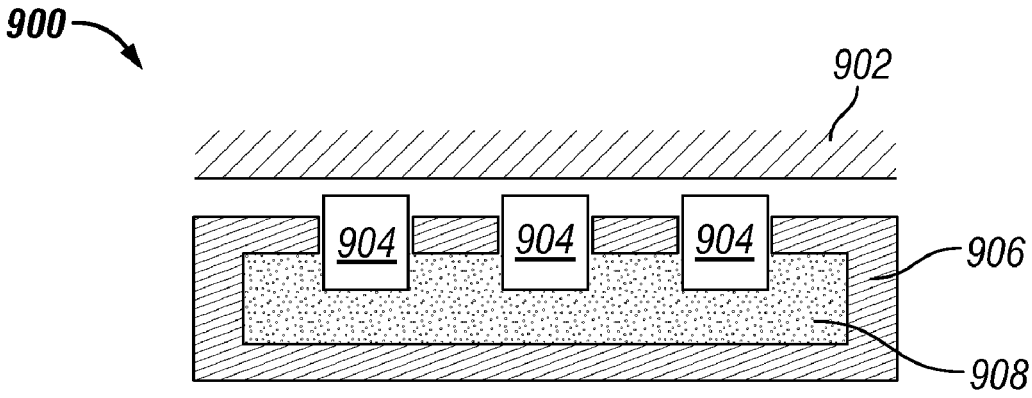
FIG. 9 is a cross-sectional side view showing a hydrostatic gripping member.

Now referring to FIG. 9, an embodiment of a grip assembly 900 using a hydrostatic mechanism is shown. As shown, a round flexible member 902 makes gripping contact with a plurality of gripping members 904. The gripping members 904 are impelled against the round flexible member 902 by action of a hydrostatic material 908 that is contained by a housing 906. The grip assembly 900 may be moved toward the round flexible member 902, for example, by a bowl and slip system. Any suitable hydrostatic material 908 may be used, including, by non-limiting example, liquids, as well solid hydrostatic media such as rubber, polymers, and the like.

The gripping members of the present invention may further comprise a wear indicating feature, such as by non-limiting example, a groove, a notch or stamp mark. Such a feature, when incorporated into the gripping member binding surface, may be used to indicate when it is worn to its service limit if the feature is flush with the gripping surface, or the feature is removed.

To further enhance any gripper member's gripping effectiveness the use of various mechanisms or techniques may be used. Suitable examples include: electrical or magneto rheological fluids, recirculating fluid to remove any low coefficient materials from the round flexible member, and rubber excluder to remove oil and paraffin, or the grippers may even have magnetic or electromagnetic properties.

The gripping binding surface may also incorporate one or more of the following features: grooved faces, circumferential, axial, and/or spiral; flat topped grooves with controlled radii transitioning from flat at the round flexible member contact to radial, where the bottom of the groove that does not contact the round flexible member may be any appropriate profile; grooves where the round flexible member is contacted by a controlled radius at the top of each groove; a pebbled surface such that the round flexible member is contacted by a large number of spherical sections, which is a cast surface or a surface produced by bonding spheres or hemispheres to the surface; a plastic or an elastomeric material containing an element or elements trapped in a steel body such that they will not extrude excessively when they are forced against the round flexible member; high friction composite gripper surfaces comprised of high friction materials such as PEEK, urethane, or brake pad material; a large number of radially oriented pieces of sheet metal, with narrow surfaces contacting the round flexible member, which are joined by rubber or springs; or texture coatings.

For special and/or emergency applications, gripping members that have profiles, such as sharp edges, nibs, or teeth, arranged to protrude into the round flexible member a distance adequate to secure the round flexible member may be used in various embodiments of injectors according to the present invention. The depth of protrusion may be controlled by any of the gripping mechanisms disclosed herein.

Embodiments of the invention also include at least one reciprocator for translating a gripping member to move the round flexible member in or out of the well bore, or for repositioning the gripping member. Any suitable technique or mechanism known in the art may be used as a reciprocator, including for example, but not limited to: hydraulic cylinders; magnetostrictive; piezoelectric; shape memory alloy; Poisson ratio cylinders (metal bar with hydraulic oil around it, lengthens when pressure is applied); annular cylinder/diaphragms; and annular pistons. When annual pistons are used with working fluid exposed to the round flexible member, pressure differential sets the gripping system, pistons carry the round flexible member through a cylinder, and the mechanism is re-set. In a preferred embodiment, the reciprocator uses a hydraulic cylinder to translate a gripping member with the working fluid isolated from the round flexible member.

In another embodiment of an injector according to the present invention, the injector is an "inchworm" like apparatus in operation. The injector comprises two or more slip gripping members which are capable of binding the outer surface of a round flexible member, actuators for enabling or disabling the gripping members which are hydraulically driven bowls that engage or disengage the slip gripping members, and at least one annular hydraulic cylinder driven reciprocator for translating a gripping member. Each gripping member and actuator forms a stroke unit, and may or may not include a reciprocator. The stroke units may be either in series (one connected to the next) or all the stroke units can be referenced to the frame of the injector.

By non-limiting example, to move the round flexible member, a first gripping member is moved relative to a first bowl actuator causing a radial inward movement of the first gripping member into binding engagement with the round flexible member. As the first gripping member is binded to the round flexible member a translating movement of the first gripping member translates the round flexible member. While the first gripping member translates the round flexible member, a second gripping member is moved in an opposite direction to that of the translation of the round flexible member. The second gripping member then binds the round flexible member at the end of the first gripping member's movement stroke, by moving relative to a second bowl actuator, which causes a radial inward movement. As the second gripping member is binded to the round flexible member a translating movement of the second gripping member translates the round flexible member. While the second gripping member translates the round flexible member, the first gripping member is reset by moving in an opposite direction to that of the translation of the round flexible member. The process is then repeated as desired. This motion may be referred to as an inch worm type of motion.

Each time this open gripper wave traverses the length of the injector, the tubing moves one stroke unit length. The speed of the round flexible member relative to this wave velocity is directly related to the number of open waves. The fastest motion is only one gripper gripping at any single time, and conversely, the slowest is only one gripper off at one time. The maximum binding force exerted will be related to the number of gripping members binding the round flexible member at one time.

In one injector embodiment based upon an inchworm design, three identical stroke units are stacked in series, each with an approximately 30 cm stroke annular hydraulic cylinder moving a slip gripping member. Each hydraulic cylinder uses an accumulator to provide up to 11,500 kilograms of snubbing force per stroke unit and uses 34.5 MPa hydraulics to provide up to 23,000 kilograms of pull per section. When all three stroke units move together and then take turns going back to the initial position, the injector can pull 69,000 kilograms in non-continuous motion. When two stroke units are pulling together while the third unit is re-positioning to pull again, it will deliver 23,000 kilograms of pull at half of its maximum speed, but with continuous motion.

Finally, with a single section pulling and the other two re-setting, it will deliver 23,000 kilograms of pull at full speed. Snubbing operations are similar, but with 34,500 kilograms, 23,000 kilograms, and 11,500 kilograms capacity. The injector can be readily scaled up or down by using two, four, or more stroke units. The only limit on the pull that can be achieved (other than the pipe) is that the housing of the bottom two stroke units must be able to carry the full load. The sections higher up in the injector typically require progressively less capacity.

Gripping members according to the present invention may be translated using a hydraulic cylinder. This may be accomplished using hydraulic cylinders with four-port/three-way control valves where both sides of the cylinder are directly driven. Also, hydraulic cylinders with three-port/three-position valves may be used with an accumulator on one side to provide the return stroke. This latter design provides better volumetric and power efficiency, but may result in more complexity to control the force in one direction. The former design allows bidirectional power flow, using the injector as a pump, at the cost of complexity. Bidirectional power flow is fail-safe, and in the event of cavitation, the round flexible member may only drop one stroke unit, as compared with a conventional injector, in which the round flexible member may fall freely. Further, valve arrangement allowing regenerative action that may be switched off offers further improvement for high-speed operation.

As an non-limiting example of the fluid dynamics for hydraulic cylinders used according to the present invention, if an injector consumes 2 liters per 30 cm of travel at 34.5 MPa, a double acting injector (with a 2:1 ratio between pull and snubbing force) will consume 3 liters per 30 cm at the same pressure. The extra 1 liter is oil used to re-set the injector piston. A single acting injector (with an accumulator on the snubbing side) will consume 2 liters per 30 cm of travel at 34.5 MPa as well. If it is required to be able to snub at full force, then it will need 34.5 Mpa of pressure. However, if the snubbing force is very low, the drive pressure can go as low as 23 Mpa. The double acting injector with a single supply is no better than 66% efficient. The single acting injector is between 66% and 100% efficient, decreasing with snubbing force. For 69,000 kilograms of force injector design, either the hydraulic system must be able to sustain (but not move during) a pressure 50% higher than normal operations or the snubbing pressure accumulator must be bled down so that the net force available from each gripper at rated force is 34,500 kilograms.

In an embodiment of the present invention, the injector's valve systems may be capable of supplying oil for translating a round flexible members up to about 45 meters per minute.

To accomplish this, direct feedback control of the valves may be used, or even applying voltages higher than the continuous rating during the shifting time and then dropping back to the rated voltage during the holding period. Speed control of the injector and the sections may be accomplished by either having each section speed controlled directly, or a master flow control valve may be used with switching valves for each section. Even in the latter case some flow modulation may be required in order to get the proper transition profiles for smooth operation.

In another embodiment of the present invention, the gripper member design has angled rollers or annular rings. A first such member binds the round flexible member surface and will make the tubing/roller system act like the round flexible member is threaded; if the set of rollers or rings is rotated around the round flexible member centerline, the round flexible member will translate in a direction parallel to the round flexible member centerline. The angle of the rollers determines the longitudinal movement of the round flexible member per rotation. A gripping member design of this type can handle a wide range of diameters.

In yet another embodiment of the invention, the gripper member design has a set of long rollers supported on their ends. When the end supports are rotated in opposite directions, the rollers come together, gripping the round flexible member. When the end supports are moved in the same direction, the rollers translate the round flexible member parallel to the centerline of the round flexible member. In this system, large diameter round flexible members move a shorter distance per rotation than small diameter round flexible members, which is generally desired.

Injectors according the invention are scalable. By scalable it is meant the two, three, four, or more stroke units comprising gripping members, actuators, and reciprocators may be combined to provide a corresponding number of round flexible member pull lengths. Injectors of the present invention may also be used as intermittent pull boosters for conventional injectors, or to vibrate the round flexible member to improve reach in horizontal wells, or even vibrate to release stuck round flexible members.

The injectors of the invention are capable of continuing to control and translate a round flexible member in scenarios wherein one or more stroke units may fail. The injector may operate with two stroke units only, or even in steps with a single stroke unit and a functional mechanism to secure the round flexible member load.

In one embodiment of the present invention, an injector is capable of a 69,000 kilogram load pull in a 30 cm stroke distance in low speed gear, a 46,000 kilogram load pull in a middle speed gear, and a 23,000 kilogram load pull in a high speed gear. The injector also has 34,500 kilogram snubbing capacity in a low speed gear, a 23,000 kilogram snubbing capacity in a medium speed gear, and a 11,500 kilogram snubbing capacity in a high speed gear.

As noted above, and as shown in FIG. 2, a stripper 40 and a blow out preventer 41 may be disposed between the injector 48 and the wellhead 42 to seal off pressure from the well 43. However, as shown for example in FIG. 10, an injector 1048 according to an alternative embodiment of the present invention may include a outer housing 1000 for containing pressure from the well 43. In such an embodiment, the construction of the blow out preventer 41 may be simplified, and/or the stripper 40 may be moved to a position above the injector 1000 rather than below as shown in FIG. 2. The outer housing 1000 may be designed to withstand any desired pressure. Common pressures are in the range of approximately 10,000 psi to 20,000 psi. As such, in one embodiment the outer housing 1000 is capable of withstanding a pressure from the wellbore of approximately 20,000 psi.

Figure 10:
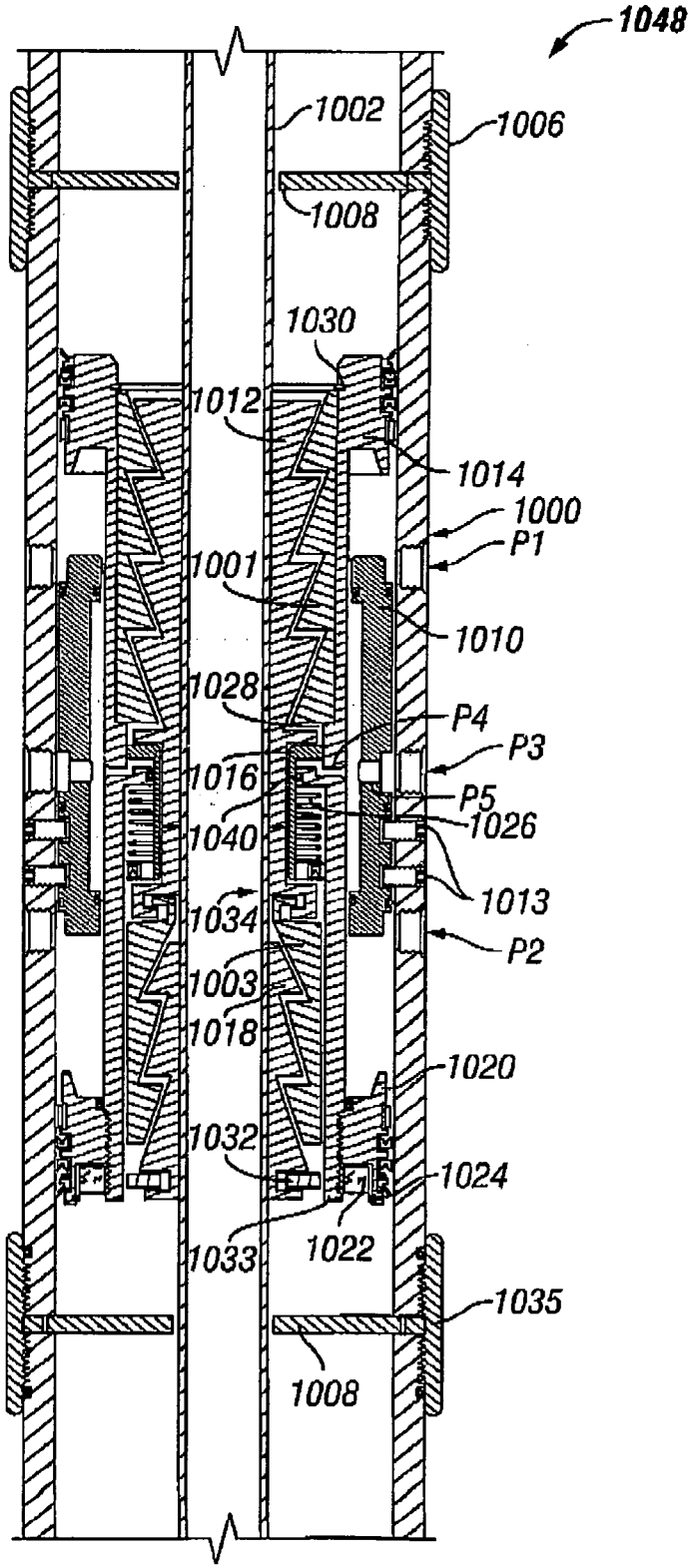
FIG. 10 illustrates, in cross-section, an injector according to another embodiment of the invention.

As shown in FIG. 10, the injector 1048 includes upper and lower actuators 1001 and 1003 in sliding contact with upper and lower gripping members 1012 and 1018. The upper and lower gripping members 1012 and 1018, in turn, are removably engaged with an elongated round flexible member 1002, hereafter referred to as coiled tubing. The actuators 1001 and 1003 and gripping members 1012 and 1018 are encased within a housing 1000. Multiple housings 1000 may be connected together by threaded couplings 1006/1035. Each housing 1000 defines a stroke unit.

At each coupling 1006/1035, a guide plate 1008 may be installed to prevent buckling of the coiled tubing 1002. A mounting bracket 1010 is fixedly mounted to the housing 1000, such as by a set of dog screws 1013, to prevent axial motion of the mounting bracket 1010 with respect to the housing 1000. The housings 1000 and couplings 1006/1035 comprise the primary pressure barrier to prevent well bore pressure and/or fluids from escaping the injector 1048. However, a reciprocator assembly (described below) is also part of this pressure barrier as it shields certain parts of the housing 1000 and the couplings 1006/1035 from the well bore pressure.

The reciprocator assembly includes a main body 1014 which is movable relative to the housing 1000 and an end section 1020 threadably coupled to the lower end of the main body 1014. The end section 1020 may include a magnet 1022 connected thereto by a retaining ring 1024. An intermediate portion of the reciprocator assembly includes a piston 1016 connected to a piston spring 1026.

The upper actuator 1001 is non-movably connected to the reciprocator assembly main body 1014, such as by being trapped between a seat 1028 and retaining ring 1030. Similarly, the lower gripping member 1018 is non-movably connected to the reciprocator assembly main body 1014, such as by use of a reciprocator assembly retainer 1032, which itself is held to the main body 1014 by a retaining ring 1033. The upper gripping member 1012 and the lower actuator 1003 are interlocked as shown at arrow 1034, such that the upper gripping member 1012 and the lower actuator 1003 move together and relative to the reciprocator assembly main body 1014.

In order to move the reciprocator assembly, upward pressure is applied thereon by allowing a hydraulic oil (or other form of pressure) through a port P1 in the housing 1000. Another port P2 in the housing 1000 is connected to a return line at low pressure. The difference in pressure between ports P1 and P2 acts on the reciprocator assembly main body 1014 and impels it upwardly (i.e., this movement causes the upper actuator 1001, the reciprocator assembly end section 1020, the magnet 1022, and the reciprocator assembly retainer 1032 to move upwardly as a unit. The upper gripping member 1012, the piston 1016, the piston spring 1026, the lower actuator 1003, and the lower gripping member 1018 are all carried therewith due to their interaction with either the reciprocator assembly retainer 1032 or a internal rib 1040 in the reciprocator assembly main body 1014. When the upper portion of the reciprocator assembly main body 1014 is adjacent to the coupling 1006, the gripping members 1012 and 1018, as well as the remainder of the components that are attached to the reciprocator assembly main body 1014 are said to be in a reset position.

Gripping of the coiled tubing 1002 is then accomplished by removing pressure from another port P3 in the housing 1000. This pressure removal causes the piston spring 1026 to expand forcing hydraulic fluid (or any other source of pressure) away from the piston 1016, through ports P4, P5 and P3 in the reciprocator assembly main body 1014, the mounting bracket 1010 and the housing 1000, respectively. The expansion of the piston spring 1026, in turn creates a downward force on the interlocking at arrow 1034 causing the upper gripping member 1012 and the lower actuator 1003 to move downwardly. This downward movement coupled with the angled sliding contact surfaces between the upper gripping member 1012 and the upper actuator 1001 causes the upper gripping member 1012 to move radially inwardly and into binding contact with the coiled tubing 1002. Further the interlocking connection shown at arrow 1034 causes the lower actuator 1003 to move downwardly with the upper gripping member 1012. This movement coupled with the angled sliding contact surfaces between the lower gripping member 1018 and the lower actuator 1003 causes the lower gripping member 1018 to move radially inwardly and into binding contact with the coiled tubing 1002.

With the gripping members 1012 and 1018 engaged in binding contact with the coiled tubing 1002, allowing a hydraulic oil (or another form of pressure) through port P2 in the housing 1000 causes a difference in pressure between ports P1 and P2 which acts on the reciprocator assembly end section 1012 and impels it downwardly, carrying the gripping members 1012 and 1018 and the coiled tubing 1002 downwardly therewith until the lower end of the reciprocator assembly end section 1012 is adjacent to the coupling 1035. At this point the gripping members 1012 and 1018 may be released from the coiled tubing 1002 by applying pressure, such as a hydraulic oil to port P3. This causes the piston spring 1026 to compress. This moves the upper gripping member 1012 and the lower actuator 1003 upwardly and hence the gripping members 1012 and 1018 radially outwardly due to their sliding contact with angled surfaces on the actuators 1001 and 1003.

The gripping members 1012 and 1018, as well as the remainder of the components that are attached to the reciprocator assembly main body 1014, may be reset by applying pressure to the port P1, creating a differential pressure between ports P1 and P2 which acts on the reciprocator assembly main body 1014 forcing it upwardly. The upward force may be continued until the upper portion of the reciprocator assembly main body 1014 is adjacent to the coupling 1006. Note that ports P1, P2 and P3 are each attached to a source of external pressure. As such, the presence of ports P1, P2 and P3 in the outer housing 1000 does not prevent the outer housing 1000 from containing pressure from the wellbore.

By operating multiple stroke units in unison, the coiled tubing 1002 may be continuously moved in an inch worm style of motion. Note that the magnet 1032 in each stroke unit is illustrated as one possible means of locating the position of the each stroke unit and allowing its speed and position to be controlled. Note that any number of stroke units may be operated in any of the manners described above with respect to the embodiments of FIGS. 1-9.

As noted above, each of the coiled tubing strings shown in FIGS. 1-10, are representative of an elongated round flexible member, which may be any of a coiled tubing string, a wireline cable, a slickline cable, an umbilical, a drill pipe, or any other elongated flexible member that is desired to be conveyed into and/or out of a well.

In embodiments where the round flexible member is a cable, the cable may be a monocable, a quadcable, a high power cable, a heptacable, a slickline cable, multiline cable, a coaxial cable, a seismic cable, and the like. Exemplary cables for use in the present invention generally include at least one insulated conductor, and at least one layer of high strength corrosion resistant armor wires surrounding the insulated conductor(s). Such insulated conductors may include metallic conductors, or even one or more optical fibers. Such conductors or optical fibers may be encased in an insulated jacket. Any suitable metallic conductors may be used. Examples of metallic conductors include, but are not necessarily limited to, copper, nickel coated copper, or aluminum. Preferred metallic conductors are copper conductors. While any suitable number of metallic conductors may be used in forming the insulated conductor, preferably from 1 to about 60 metallic conductors are used, more preferably 7, 19, or 37 metallic conductors.

Components, such as conductors, armor wires, filler, optical fibers, and the like, used in exemplary cables for use in the present invention may be positioned at a zero helix angle or any suitable helix angle relative to the center axis of the cable. Generally, a central insulated conductor is positioned at a zero helix angle, while those components surrounding the central insulated conductor are helically positioned around the central insulated conductor at desired helix angles. A pair of layered armor wire layers may be contra-helically wound, or positioned at opposite helix angles.

Cables used in the present invention may be used with wellbore devices to perform operations in wellbores, penetrating geologic formations that may contain gas and oil reserves. The cables may be used to interconnect well logging tools, such as gamma-ray emitters/receivers, caliper devices, resistivity measuring devices, seismic devices, neutron emitters/receivers, and the like, to one or more power supplies and data logging equipment outside the well. Cables used in the present invention may also be useful for a variety of applications including seismic operations including subsea and subterranean seismic operations, the cables may also be useful as permanent monitoring cables or wellbores.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An injector comprising:

a plurality of axially spaced gripping members, wherein each of the plurality of gripping members removably binds an outer surface of an elongated round flexible member;

at least one actuator engaged with the plurality of gripping members in a manner that allows the plurality of gripping members to bind or release the elongated round flexible member, wherein each gripping member in the plurality of gripping members comprises a plurality of wedge shaped surfaces in contact with a corresponding plurality of wedge shaped surfaces on the at least one actuator, such that a sliding engagement of the wedge shaped surfaces of the plurality of gripping members with the wedge shaped surfaces of the at least one actuator causes the plurality of gripping members to bind or release the elongated round flexible member; and at least one reciprocator for translating the plurality of gripping members, wherein said translating causes the elongated round flexible member to translate when the plurality of gripping members bind the outer surface of the elongated round flexible member, and wherein said translating causes the plurality of gripping members to reset when the plurality of gripping members release the outer surface of the elongated round flexible member.

2. The injector of claim 1, wherein the elongated round flexible member is chosen from the group consisting of a coiled tubing string, a wireline cable, a slickline cable, an umbilical, and a drill pipe.

3. The injector of claim 1, wherein the elongated round flexible member is chosen from the group consisting of a coiled tubing string, and an elongated cable.

4. The injector of claim 1, wherein the plurality of gripping members combine to circumferentially bind the outer surface of the elongated round flexible member.

5. The injector of claim 1, wherein each gripping member in the plurality of gripping members is a slip type gripping member, and the at least one actuator slidably engages the plurality of gripping members to allow the plurality of gripping members to bind or release the elongated round flexible member.

6. The injector of claim 1, wherein the inner surface of each gripping member in the plurality of gripping members is collet shaped.

7. The injector of claim 1, wherein the at least one reciprocator is hydraulically driven.

8. The injector of claim 1, wherein the at least one reciprocator drives one of the plurality of gripping members and the at least one actuator; while the other of the plurality of gripping members and the at least one actuator is stationary.

9. The injector of claim 1, wherein each gripping member in the plurality of gripping members further comprises a mechanism for enhancing binding to the elongated round flexible member, wherein said mechanism is chosen from the group consisting of grooves on an inner surface of each gripping member, a pebbled surface on an inner surface of each gripping member, a plastic material on an inner surface of each gripping member, an elastomeric material on an inner surface of each gripping member, and a high friction material on an inner surface of each gripping member.

10. The injector of claim 1, wherein each gripping member in the plurality of gripping members comprises a wear indicating feature.

11. An injector comprising:

a first stroke unit comprising:

a first gripping member that removably binds an outer circumferential surface of an elongated round flexible member, a first actuator engaged with the first gripping member in a manner that allows the first gripping member to bind or release the elongated round flexible member, and a first reciprocator for translating the first gripping member, wherein said translating causes the elongated round flexible member to translate when the first gripping member binds the elongated round flexible member, and wherein said translating causes the first gripping member to reset when the first gripping member releases the elongated round flexible member; and a second stroke unit comprising:

a second gripping member that removably binds the outer circumferential surface of the elongated round flexible member, a second actuator engaged with the second gripping member in a manner that allows the second gripping member to bind or release the elongated round flexible member, and a second reciprocator for translating the second gripping member, wherein said translating causes the elongated round flexible member to translate when the second gripping member binds the elongated round flexible member, and wherein said translating causes the second gripping member to reset when the second gripping member releases the elongated round flexible member, wherein the first stroke unit and the second stroke unit are axially spaced from one another and wherein the first gripping member and the second actuator are interlocked such that the first gripping member and the second actuator translate together.

12. The injector of claim 11, wherein the first and second gripping members alternatively bind and translate the outer circumferential surface of the elongated round flexible member to provide a continuous translational movement to the elongated round flexible member.

13. The injector of claim 11, wherein the elongated round flexible member is chosen from the group consisting of a coiled tubing string, a wireline cable, a slickline cable, an umbilical, and a drill pipe.

14. The injector of claim 11, wherein the elongated round flexible member is chosen from the group consisting of a coiled tubing string, and an elongated cable.

15. The injector of claim 11, wherein the first and second gripping members are each slip type gripping members, and wherein the first and second actuators each slidably engage a corresponding one of the first and second gripping members to allow the first and second gripping members to bind or release the outer circumferential surface of the elongated round flexible member.

16. The injector of claim 11, wherein the first and second gripping members each have a wedge shaped surface in contact with a wedge shaped surface on a corresponding one of the first and second actuators, such that a sliding engagement of the contacting wedge shaped surfaces causes the first and second gripping members to bind or release the outer circumferential surface of the elongated round flexible member.

17. The injector of claim 11, further comprising a third stroke unit.

18. An injector for translating an elongated round flexible member relative to a wellbore, the injector comprising:

a stroke unit comprising:

a plurality of gripping members, wherein each of the plurality of gripping members removably binds the outer surface of an elongated round flexible member, at least one actuator engaged with the plurality of gripping members in a manner that allows the plurality of gripping members to bind or release the elongated round flexible member, and at least one reciprocator for translating the plurality of gripping members, wherein said translating causes the elongated round flexible member to translate when the plurality of gripping members bind the outer surface of the elongated round flexible member, and wherein said translating causes the plurality of gripping members to reset when the plurality of gripping members release the outer surface of the elongated round flexible member; and an outer housing in surrounding relation to the stroke unit for containing pressure from the wellbore and for receiving pressure to act on the at least one reciprocator for translating the at least one reciprocator; and a stripper disposed at one of above and below the outer housing.

19. The injector of claim 18, wherein the pressure from the wellbore is in the range of approximately 0 psi to 20,000 psi.

20. The injector of claim 18, the outer housing is capable of withstanding a pressure from the wellbore of approximately 20,000 psi.

21. The injector of claim 18, wherein the elongated round flexible member is chosen from the group consisting of a coiled tubing string, a wireline cable, a slickline cable, an umbilical, and a drill pipe.

22. The injector of claim 18, wherein the elongated round flexible member is chosen from the group consisting of a coiled tubing string, and an elongated cable.

23. The injector of claim 18, wherein the outer housing comprises a first port for receiving the pressure which causes the at least one reciprocator to move in a first direction.

24. The injector of claim 18, wherein the outer housing comprises a second port for receiving the pressure which causes the at least one reciprocator to move in a second direction.

25. The injector of claim 18, wherein the outer housing comprises a third port for receiving the pressure which causes the plurality of gripping members to move relative to the at least one actuator.

26. A method of translating a elongated round flexible member comprising:

binding an outer surface of the elongated round flexible member with at least one gripping member by engagement with an actuator, wherein the elongated round flexible member is chosen from the group consisting of a coiled tubing string and a cable;

translating said at least one gripping member by a reciprocator to move the elongated round flexible member, wherein the actuator and the reciprocator are disposed in an outer housing in surrounding relation to the actuator and reciprocator for containing pressure from the wellbore and for receiving pressure to act on the at least one reciprocator for translating the at least one reciprocator; and a stripper disposed at one of above and below the outer housing.

27. The method of claim 26, wherein gripping member comprises a plurality of gripping members and wherein each gripping member in the plurality of gripping members comprises a plurality of wedge shaped surfaces in contact with a corresponding plurality of wedge shaped surfaces on the at least one actuator, such that a sliding engagement of the wedge shaped surfaces of the plurality of gripping members with the wedge shaped surfaces of the at least one actuator causes the plurality of gripping members to bind or release the elongated round flexible member.

* * * * *